United States Patent [19]

Pagnini

[11] 4,130,229

[45] Dec. 19, 1978

[54] TAPE DISPENSER

[76] Inventor: Edillio Pagnini, 301 S. Main St., Hopedale, Mass. 01747

[21] Appl. No.: 828,292

[22] Filed: Aug. 26, 1977

[51] Int. Cl.[2] ..... B26F 3/02

[52] U.S. Cl. ..... 225/33; 225/42; 225/77; 225/90; 242/55.2

[58] Field of Search ..... 225/33, 42, 77, 80, 225/90, 91; 312/41, 245; 242/55.2, 68.3

[56] References Cited

U.S. PATENT DOCUMENTS

| | | | |
|---|---|---|---|
| 2,419,798 | 4/1947 | Stone | 242/55.2 |
| 2,615,326 | 10/1952 | Matthews | 225/33 X |
| 2,701,692 | 2/1955 | Guyer | 225/33 |
| 3,489,324 | 1/1970 | Stohl | 225/42 X |
| 3,502,252 | 3/1970 | Mariani | 225/33 |
| 3,593,936 | 7/1971 | Davis | 242/55.2 |

*Primary Examiner*—Frank T. Yost

*Attorney, Agent, or Firm*—Clarence A. O'Brien; Harvey B. Jacobson

[57] ABSTRACT

A dispenser for adhesive tape, and the like, has a spool arrangement supported by a base member and disposed for receiving a roll of tape. A cap including a head portion and a plug portion removably retains a roll of tape on a spindle partially forming the spool arrangement, which spindle has a recess in an end surface thereof for selectively receiving the plug portion of the cap. The base member is selectively mountable on a wall surface, and the like, as by suitable fasteners or by an adhesive, and the like. Also provided on the base member, in addition to the spool arrangement, is a double-edge cutting arrangement disposed for severing tape wound in either tangential direction from a roll journaled on the spindle of the spool arrangement.

8 Claims, 3 Drawing Figures

TAPE DISPENSER

BACKGROUND OF THE INVENTION

1. Field of the Invention

This invention relates generally to tape dispensers, and particularly to a tape dispenser especially suited for being mounted on a substantially vertical wall surface, such as the side of a cash register, and the like.

2. Description of the Prior Art

A continuing source of aggrevation and loss of time in business establishments of various kinds is created by the movement of the conventional tape dispensers. As these dispensers are frequently removed from a given location again and again by members of a working staff, or even family members when the dispenser is used in a home, persons who subsequently wish to use the dispenser must expend time to track it down.

Tape dispensers are known, such as disclosed in U.S. Pat. No. 2,910,217, issued Oct. 27, 1959, to G. W. Emmert, et al., which include a reel holder and cutting blade disposed on a frame mountable on a vertical wall surface, and the like. Further, it is also known, as disclosed in U.S. Pat. No. 3,489,324, issued Jan. 13, 1970, to M. R. Stohl, to provide a tape dispenser which employs a double-edge cutting blade in order to permit tape to be unwound from a roll in either tangential direction from the outer layer of the roll of tape.

SUMMARY OF THE INVENTION

It is an object of the present invention to provide a tape dispenser particularly suited for dispensing tape when mounted on a substantially vertical surface.

It is another object of the present invention to provide a tape dispenser which can be mounted in either opposite direction relative to an operator without affecting the efficiency of the dispenser to perform its intended function.

Yet another object of the present invention is to provide a tape dispenser which can be readily affixed to, for example, suitable vertical surfaces, and the like.

These and other objects are achieved according to the present invention by providing a dispenser having: a spool arrangement disposed for receiving a roll of tape to be dispensed; a mounting arrangement supporting the spool arrangement; and a cutting assembly provided on the mounting arrangement for severing tape wound from a roll of tape arranged on the spool arrangement.

The spool arrangement preferably includes a spindle affixed to the mounting arrangement, with the spindle having a substantially cylindrical bearing surface which receives the roll of tape to be dispensed. The spindle further has an end surface from the mounting arrangement and provided with a recess. The spindle arrangement further includes a tape roll retaining cap comprising a roll restraining head portion and a plug portion attached to and oriented extending from the head portion, with the plug portion being removably arrangeable in the recess provided in the end surface of the spindle for retaining the tape roll on the spindle.

The mounting arrangement advantageously includes a base member having a pair of spaced, planar faces arranged converging towards one another, with the cutting assembly and the spindle of the spool arrangement being disposed on one of the faces of the base member. The faces converge toward one another from the cutting assembly toward the spindle for making the pull on the tape being dispensed slightly away from the plane of the other of the faces whereby the tape is easier to handle.

An attachment arrangement is provided on the other of the faces of the base member for mounting the base member on a wall member, such as the side of a cash register, bookcase, or just a vertical wall surface. This attachment can be achieved either by the use of suitable fasteners, such as nails or screws, disposed in holes provided in the base member, or a layer of adhesive, such as that formed by a conventional double-faced adhesive tape, can be applied to the other of the faces of the base member.

The cutting assembly preferably includes a cutting platform cantilever mounted on the base member and provided with two, spaced, oppositely directed cutting edges arranged for selectively severing tape independence on the direction which the tape is being unwound from its roll.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
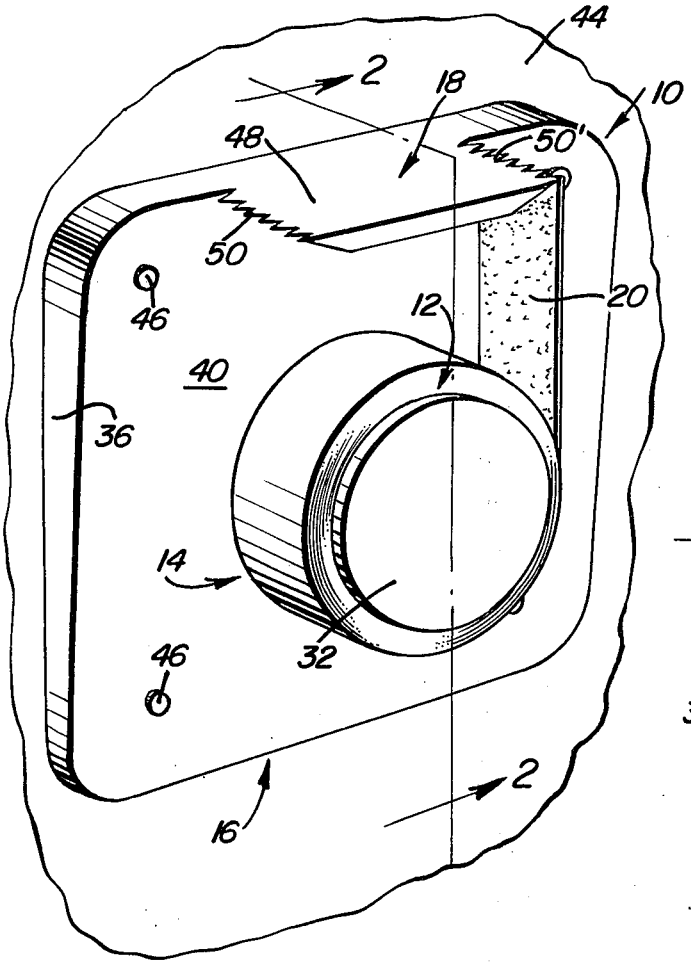
FIG. 1 is a fragmentary, perspective view showing a tape dispenser according to the present invention mounted on a vertical wall surface.

Referring now more particularly to the figures of the drawing, a dispenser 10 for adhesive tape, and the like, of conventional construction comprises a spool 12 arranged for receiving a roll 14 of suitable tape. A mounting arrangement 16 supports spool 12, while a cutting assembly 18 provided on mounting arrangement 16 severs tape 20 wound from roll 14.

Spool 12 includes a spindle 22 affixed to mounting arrangement 16, with spindle 22 having a substantially cylindrical bearing surface 24 arranged for receiving the roll 14 of tape. Spindle 22 further has an end surface 26 spaced from the mounting arrangement 16 and provided with a recess 28 therein. The spool 12 further includes a tape roll retaining cap 30 comprising a roll restraining head portion 32 and a plug portion 34, with the latter being removably arrangeable in recess 28 for permitting head portion 32 to retain roll 14 on spindle 22.

Mounting arrangement 16 includes a base member 36 having a pair of spaced, planar faces 38 and 40 arranged converging toward one another. The cutting assembly 18 and spindle 22 are disposed on face 40, and faces 38 and 40 converge toward one another from the cutting assembly 18 toward spindle 22 for making the pull on tape 20 slightly away from the plane of face 38. This slight pull away from the attachment of base member 36 makes it easier to handle tape 20 during a dispensing operation.

Base member 36 can be mounted on a vertical surface as by provision of a plurality of holes 42, four such holes 42 being shown, so as to permit base member 36 to be attached to a suitable wall 44 with face 38 abutting same as by the use of the illustrated nails 46, or screw fasteners (not shown), or the like. Alternatively, base member 36 could be provided with a, for example, conventional double-faced adhesive tape (not shown) and adhered to wall 44.

Figure 2:
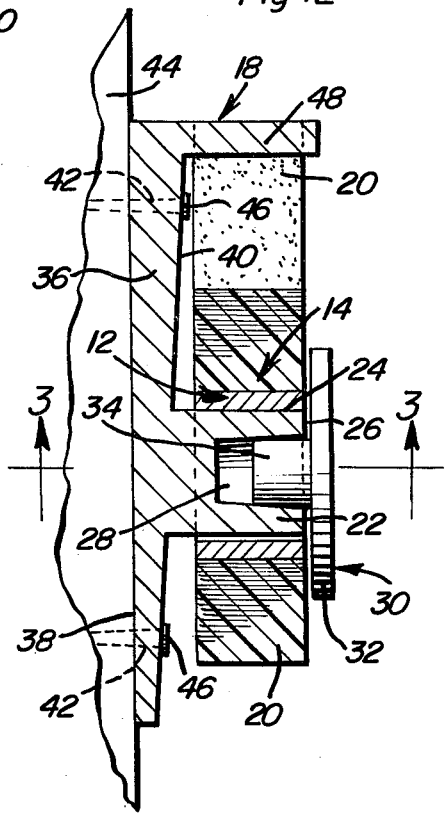
FIG. 2 is a fragmentary, sectional view taken generally along the line 2—2 of FIG. 1.
Figure 3:
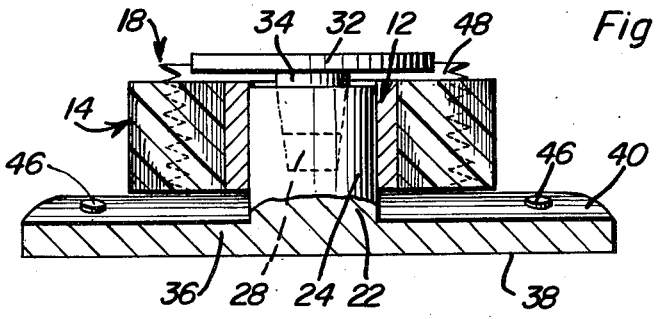
FIG. 3 is a sectional view taken generally along the line 3—3 of FIG. 2.

Cutting assembly 18 includes a cutting platform 48 cantilever mounted on face 40 of base member 36, and provided with two spaced, oppositely directed cutting edges 50 and 50′ arranged for selectively severing tape 20 in dependence on the orientation of the roll 14 of tape on the spindle 22 of spool 12. That is, if the roll 14 were reversed from the orientation seen in FIGS. 1 and 2 of the drawing, edge 50 would be severing tape 20 instead of edge 50′ as illustrated.

As can be readily understood from the above description and from the drawing, a tape dispenser according to the present invention can be readily affixed to a convenient location and tape dispensed therefrom. Further, the dispenser is not limited to a particular orientation on the vertical or otherwise oriented surface on which it is mounted.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A dispenser for adhesive tape, and the like, comprising, in combination:
   (a) spool means for receiving a roll of tape;
   (b) mounting means supporting the spool means; and
   (c) cutting means provided on the mounting means for severing tape wound from a roll arrangeable on the spool means, the mounting means including a base member having a pair of spaced, planar faces arranged converging toward one another, the cutting means and spool means being disposed on one of the faces, and the faces converging toward one another from the cutting means toward the spool means for making a pull on tape being dispensed slightly away from the plane of the other of the faces.

2. A structure as defined in claim 1, wherein the spool means includes a spindle affixed to the mounting means, the spindle having a substantially cylindrical bearing surface, which receives the roll of tape.

3. A structure as defined in claim 2, wherein the spindle further has an end surface spaced from the mounting means and provided with a recess, and the spool means further including a tape roll retaining cap including a roll restraining head portion and a plug portion extending away from the head portion, with the plug portion being removably arrangeable in the recess provided in the end surface of the spindle for positioning the head portion to retain the tape roll on the spindle.

4. A structure as defined in claim 1, wherein attachment means are provided on the base member for mounting the base member on a wall member, with the other of the faces of the base member being arrangeable abutting the wall member.

5. A structure as defined in claim 1, wherein the cutting means includes a cutting platform cantilever mounted on the mounting means and provided with two spaced, oppositely directed cutting edges arranged for selectively severing tape in dependence on the orientation of the roll of tape arrangeable on the spool means.

6. A dispenser for adhesive tape, and the like, comprising, in combination:
   (a) spool means for receiving a roll of tape;
   (b) mounting means supporting the spool means; and
   (c) cutting means provided on the mounting means for severing tape wound from a roll arrangeable on the spool means, the spool means including a spindle affixed to the mounting means, the spindle having a substantially cylindrical bearing surface, which receives the roll of tape, the spindle further having an end surface spaced from the mounting means and provided with a recess, and the spool means further including a tape roll retaining cap including a roll restraining head portion and a plug portion extending away from the head portion, with the plug portion being removably arrangeable in the recess provided in the end surface of the spindle for positioning the head portion to retain the tape roll on the spindle, the mounting means including a base member having a pair of spaced, planar faces arranged converging toward one another, the cutting means and spindle being disposed on one of the faces, and the faces converging toward one another from the cutting means toward the spindle for making a pull on tape being dispensed slightly away from the plane of the other of the faces of the base member.

7. A structure as defined in claim 6, wherein attachment means are provided on the base member for mounting the base member on a wall member, with the other of the faces of the base member being arrangeable abutting the wall member.

8. A structure as defined in claim 7, wherein the cutting means includes a cutting platform cantilever mounted on the base member and provided with two spaced, oppositely directed cutting edges arranged for selectively severing tape in dependence on the orientation of the roll of tape on the spool means.

* * * * *